US005140908A

United States Patent [19]

Sullivan, Jr.

[11] Patent Number: 5,140,908

[45] Date of Patent: Aug. 25, 1992

[54] LIQUID EXPLOSIVE WITH INITIATOR

[75] Inventor: John D. Sullivan, Jr., Edgewood, Md.

[73] Assignee: The United States of America as represented by the Secretary of the Army, Washington, D.C.

[21] Appl. No.: 828,618

[22] Filed: Jan. 31, 1992

[51] Int. Cl.[5] ..... F42B 3/00

[52] U.S. Cl. ..... 102/322; 149/89

[58] Field of Search ..... 149/89; 102/322

[56] References Cited

U.S. PATENT DOCUMENTS

| | | | |
|---|---|---|---|
| 3,868,457 | 2/1975 | Black et al. | 424/273 |
| 3,968,216 | 7/1976 | Black et al. | 424/263 |
| 4,088,769 | 5/1978 | Black et al. | 424/270 |

*Primary Examiner*—Stephen J. Lechert, Jr.
*Attorney, Agent, or Firm*—Saul Elbaum; Muzio B. Roberto

[57] ABSTRACT

An explosive composition of matter comprising nitromethane and picric acid. In a preferred embodiment of the invention commercially available picric acid containing up to 10 percent water by weight is added to the nitromethane up to saturation at room temperature.

6 Claims, No Drawings

LIQUID EXPLOSIVE WITH INITIATOR

RIGHTS OF THE GOVERNMENT

The invention described herein may be manufactured, used, and licensed by or for the government, for Governmental puroses without the payment to me of any royalties.

BACKGROUND OF THE INVENTION

1. Technical Field

This invention relates to a new composition of matter in the form of a liquid organic explosive mixture consisting essentially of nitromethane and picric acid.

2. Brief Description of the Prior Art

Nitromethane was first synthesized in 1872 by Kolbe. However, it is so insensitive that it was not until 1938 that McKittrick found that it could be detonated. Sensitizers were found during research conducted during World War II, primary amines, which made nitromethane detonated using a blasting cap.

Picric acid was isolated by Hausmann in 1778. It was used as a yellow dye until Turpin processed it uses as a bursting charge in a high explosive shell. Mixtures of explosives and picric acid wee developed. The use continued until about 1900, when the explosive was gradually replaced by Trinitrotoluene. Presently, picric acid is sued only in the manufacture of Explosive D, i.e., ammonium picrate used a High Explosive fill for armor-piercing shells.

In addition to its historic, well-known use as a dye, picric acid is used in an identification ink to mark laboratory animals. Further, BUTESIN icrate (Trademark of Abbott Laboratories) is a local skin anesthetic used in burn treatment.

While nitromethane and picric acid are each separately known in the explosive art, it is not obvious to combine them or that the combination would result in a useful product.

The following patents containing nitromethane in combination with other material(s) are described below. However, none of these patents suggest the present combination.

U.S. Pat. No. 3,288,867 discloses the stabilization of nitromethane by the addition thereto of a stabilizing liquid such as acetone, benzene, 1,2 butylene oxide, cyclohexanone, methylene chloride etc. to provide a safe method for the bulk transportation of nitromethane.

U.S. Pat. No. 3,309,251 discloses the preparation of a liquid organic explosive mixture consisting primarily of a mono-nitromethane and a hydrated or anhydrous amine. A nonexplsoive diluent, such as glycerine, ehtyl alcohol and ethyl celosolve may also be added.

U.S. Pat. No. 4,5634,480 discloses the preparation a aqueous explosive composition comprising nitromethane and nitric acid.

U.S. Pat. No. 2,338,120 discloses the desensitization of nitroglycerine by the addition of nitromethane.

SUMMARY OF THE INVENTION

It is an object of the present invention to provide and disclose the combination of commercially available materials to produce a novel explosive composition having a high density for commercial use.

The present explosive aqueous composition of matter is prepared using industrial grade chemicals. The picric acid is commercially available containing 10 per cent water, which renders it safe for shelf storage. It has been found that picric acid is highly soluble, i.e., 87.5 percent by weight at room temperature, in nitromethane. All proportions of the picric acid and nitromethane mixture are operable up to saturation. The composition is prepared by simply adding the picric acid to the nitromethane and mixing.

DESCRIPTION OF THE PREFERRED EMBODIMENT

A series of ternary mixtures were prepared using nitromethane (NM), picric acid (PIC) and morpholine (MOR) as a sensitizer in the percent by weight basis shown in TABLE 1. Commercial grades reactant were utilized. The picric acid contained 10 percent water by weight. The ingredients were mixed at room temperature.

A mixture of 35 ml from each series was placed in an aluminum can positioned on top of a witness plate of 12 mm mild steel. A booster pellet and detonator, amounting to 6.2 grams of high explosives, were used to detonate the mixture. The pellet, wrapped in aluminum to avoid any incompatibility, was immersed 12 mm into the test mixture through a wooden centering lid.

TABLE 1

| Example | Mixture by weight (NM/PIC/MOR) | Clear hole diameter (mm) in 12-mm mild steel |
|---|---|---|
| 1. | 70/24/6 | 187 |
| 2. | 81/13/6 | 176 |
| 3. | 51/44/5 | 187 |
| 4. | 92/0/8 | 165 |

All of the above mixtures containing from 0 to 44% acid detonated and produced a hole which as comparable in diameter. the 12-mm mild steel was overmatched by explosions from all wide-ranging proportions of mixture. The maximum acid mixture (Example 3) on detonation produced a hole of 187 mm, in comparison to 165 (Example 4)) which contained zero per cent picric acid. This indicates that the picric acid was an active ingredient in the explosive.

The aqueous explosive composition of matter was further evaluated as shown in TABLE 11 using nitromethane and picric acid. A sensitizer was omitted from the mixture of Examples 1. and 2. Picric acid was omitted from the mixture in Example 3. The method of preparation was identical to that used for the preparation of the mixtures shown in TABLE 1.

TABLE 11

| Example | Mixture (NM/PIC) | Armor Plate (mm) | Results |
|---|---|---|---|
| 1. | NM/PIC 53.5/46.5% 257 ml/252 g. | 16 | Severe distortion to plate. Spall mass 91.2 g. Hole diameter = 1 plate thickness. |
| 2. | NM/PIC 100/0 335 ml/0 g. | 16 | Less plate distortion than 1. Spall mass 79.0 g. Hole diameter = 2/5 plate thickness |
| 3. | NM/MOR 192/08 256 ml/27 ml | 16 | NM amount matches Example 1. Spall mass 73.1 g. No hole in plate. |

The preferred mixture (Example 1) caused large distortion of the plate, and a high spell mass. The mixture of (Example 2), having no picric acid, caused less plate distortion and less spall mass. This shows the superiority of the preferred solution over a baseline liquid explosive. Example 1. also shows that the sensitizer may be omitted with no detrimental effect to he explosive composition.

The aqueous liquid explosive was further evaluated in comparison with nitromethane/picric acid (dry) and other nitromethane/nitric acid compositions as shown in TABLE 111. In the evaluation, cans containing 335 ml of the explosive were fired one foot away from a ballistic pendulum. A booster pellet (6.2 grams) initiator was used. The mixture was detonated. The shock was from the explosion strikes a a massive bob, and swings it. The distance that the bob swings can be used to rank the strength of the explosive mixtures. Example 1. comprising nitromethane/picric acid(dry) exhibited the longest pendulum swing.

TABLE 111

| Example | Mixture (mm) | Swing Distance | Calculated Impulse (Newton-second) |
|---|---|---|---|
| 1. | NM/PIC (dry) | 601 | 400 |
| 2. | NM/PIC (wet) 53.5/46.5 | 552 | 373 |
| 3. | NM/NO3 (70%) | 525 | 349 |

Density or mass/volume to the waterless (dry) saturated mixture is 1.356g/ml. Density of the preferred mixture NM/PIC (wet) was determined by weighing a 50.0 ml. volumetric flask of the mixture. Measurements gave 1.274 g/m.

The preferred mixture may contain water up to 10 percent by weight of the picric acid. While there is a loss in performance in the wet composition compared with the dry mixture (TABLE 111), it is compensated for in that picric acid is commercially available in a 10 percent aqueous solution. This allows the commercial picric acid to be added to nitromethane without any additional preparation or drying.

Having described my invention I claim:

1. An explosive composition of matter comprising nitromethane and picric acid, and an initiator.

2. An explosive composition of matter in accordance with claim 1. wherein the initiator comprises a booster pellet and detonator.

3. An explosive composition of matter in accordance with claim 2. wherein the picric acid contains up to 10 per cent water by weight.

4. An explosive composition in accordance with claim 3. wherein the nitromethane and picric acid have a weight ratio of about 53.5 to 46.5, respectively.

5. An explosive composition in accordance with claim 4. wherein the picric acid is dissolved in the nitromethane up to saturation.

6. An explosive composition in accordance with claim 5. wherein the mixture has a density of 1.274 g/ml.

* * * * *